US005186410A

United States Patent [19]

Toews

[11] Patent Number: 5,186,410

[45] Date of Patent: Feb. 16, 1993

[54] WIRE REEL MECHANISM

[76] Inventor: Timothy R. Toews, 41390 Hwy. 226, Scio, Oreg. 97374

[21] Appl. No.: 714,037

[22] Filed: Jun. 12, 1991

[51] Int. Cl.[5] ..... B65H 75/40

[52] U.S. Cl. ..... 242/86.5 R; 242/86.7; 242/99; 242/106; 254/323; 296/43

[58] Field of Search ..... 242/86.5 R, 86.5 A, 242/86.7, 96, 99, 106, 85, 86, 86.2, 86.52, 156, 86.8, 86.64, 250; 254/323, 361; 296/43; 410/110

[56] References Cited

U.S. PATENT DOCUMENTS

| | | | |
|---|---|---|---|
| 498,307 | 5/1893 | Rule | 242/106 X |
| 522,503 | 7/1894 | De Bem | 242/86.8 X |
| 667,788 | 2/1901 | Murchison | 242/86.8 |
| 2,709,867 | 6/1955 | Routh | 242/250 X |
| 2,927,772 | 3/1960 | Kanouse | 242/106 X |
| 2,998,796 | 9/1961 | Wittrock | 242/86.5 A X |
| 3,070,324 | 12/1962 | Bryman | 242/86.5 R |
| 3,421,726 | 1/1969 | Getter | 296/43 X |
| 4,190,211 | 2/1980 | Janzen | 242/86.7 |
| 4,278,214 | 7/1981 | Caldwell | 242/106 |
| 4,747,561 | 5/1988 | Sweeny et al. | 242/96 |
| 4,812,093 | 3/1989 | Millar, Jr. | 296/43 X |
| 4,946,113 | 8/1990 | Riffle et al. | 242/86.5 R |
| 4,962,901 | 10/1990 | Shirley et al. | 242/250 X |

*Primary Examiner*—Stanley N. Gilreath

[57] ABSTRACT

A device for winding wire onto or off of a spool, especially in conjunction with the laying or take up of fence wire. The device includes a platform having a depending post structure adapted to fit into a stake pocket in the side wall of a pickup truck cargo box. The platform is located directly above the cargo box side wall to rotatably support a shaft that extends transversely across the plane of the side wall. The spool is located outboard from the truck; a hand crank (or electric motor) is connected to the inboard end of the shaft, such that a person sitting in the truck can control the wire winding (or unwinding) operation.

1 Claim, 1 Drawing Sheet

WIRE REEL MECHANISM

BACKGROUND AND SUMMARY OF THE INVENTION

This invention relates to a device for winding or unwinding wire onto or off of a spool. The invention is particularly useful in laying down or picking up electric fence wire in a ranch or farm environment.

It is known to carry fence wire or communication wire on a truck or off-road vehicle, as described, e.g. in U.S. Pat. No. 3,070,324 to K. Bryman or U.S. Pat. No. 4,946,113 to Riffle et al. The vehicle is driven slowly over the terrain while a spool of wire is rotated at a controlled rate to either wind the wire onto the spool or unwind the wire from the spool. The wire-unwind action occurs naturally as an incident to the vehicle motion, without any power input to the spool. the wire-winding action requires a power input to the spool, e.g. manual operation of a hand crank or electric operation of a motor.

The present invention concerns a relatively simple low cost mechanism for mounting the spool and its operating mechanism on the rear end of a conventional pickup truck. The operating mechanism is supported on a horizontal platform that has a downwardly extending post structure disposed for insertion into one of the stake pockets in the side wall of the truck cargo box. A horizontal axis bearing means is located on the platform for rotatably supporting a horizontal shaft that extends transversely across the cargo box side wall; one end of the shaft is located within the cargo box, and the other end of the shaft is located outboard from the cargo box. A spool of wire is supported on the outboard end of the shaft. A shaft-operating means is connected to the inboard end of the shaft. The shaft-operating means can be a hand crank or an electric motor. A person sitting in the cargo box can control the spool motion.

THE DRAWINGS

DESCRIPTION OF A PREFERRED EMBODIMENT OF THE INVENTION

Figure 1:
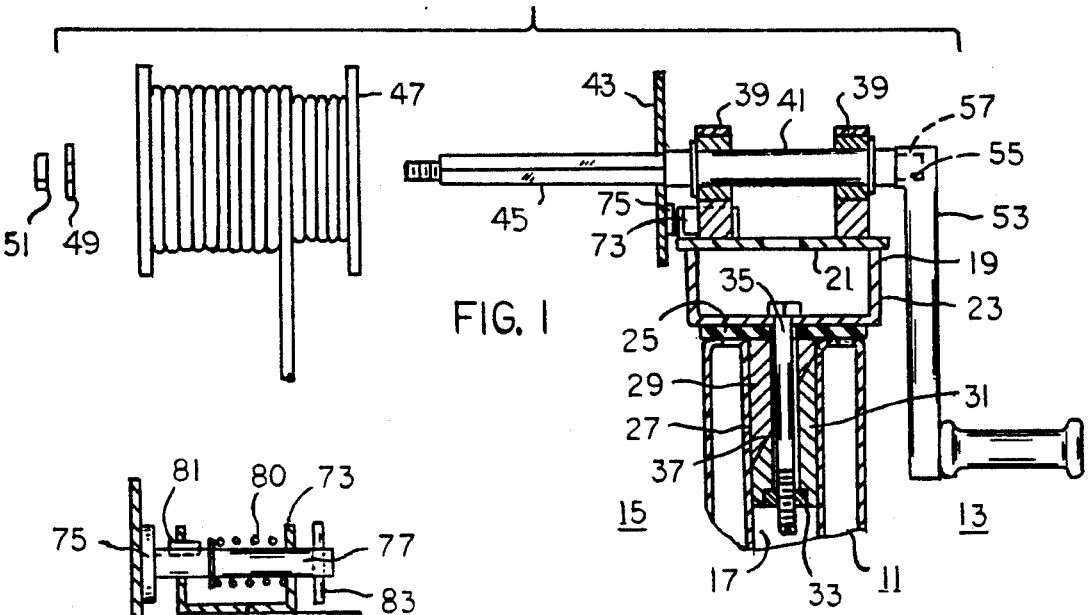
FIG. 1 is an exploded view of a wire winding-unwinding device embodying the invention.

FIG. 1 fragmentarily shows a side wall 11 of a conventional pickup truck cargo box. Area 13 to the right of the side wall would be within the cargo box. Area 15 to the left of wall 11 would be outside (outboard) of the cargo box. The conventional cargo box side wall has a number of vertical pockets therein adapted to act as anchorages for stakes that are sometimes used to effectively increase the height of the cargo box side wall. Numeral 17 references one of these stake pockets; the present invention utilizes the stake pocket for mounting the invention wire winding-unwinding mechanism.

The mechanism includes a platform 19 that comprises a steel plate 21 and a reinforcement channel 23. A resilient cushioner pad 25 is adhesively attached to the undersurface of channel 23 to protect the upper edge of wall 11 from scratching when the platform is positioned thereon.

Extending downwardly from platform 19 is a multipiece post 27 that includes an upper block-like post section 29 and a lower block-like post section 31. An internally threaded nut 33 is affixed to post section 31 for meshed engagement with a threaded tie rod (bolt) 35 that extends downwardly through oversize holes in post sections 29 and 31.

Post sections 29 and 31 have mating cam surfaces 37 acutely angled to the axis of tie rod 35, such that manual rotation of the tie rod in one direction draws post section 31 upwardly into pressure engagement with post section 29, whereupon the cam surfaces 37 cause the post sections to shift laterally in opposite directions so that side surfaces of the post sections come into gripment with the side surfaces of pocket 17. The platform 19 is thus securely clamped in a fixed position atop the cargo box side wall 11. Reverse manual rotation of tie rod 35 causes the post sections to shift laterally out of gripment with the pocket 17 side surfaces, thereby permitting removal of platform 19 from the truck.

Two pillow block bearings 39 are suitably bolted to plate 21 for rotatably supporting a shaft 41. The shaft extends transversely across the plane of wall 11 so that the right end of the shaft is located within the cargo box and the left end of the shaft is located outboard from the cargo box (in area 15). A circular radial disk 43 is attached to the left end of shaft 41. Also, a non-circular spindle 45 extends axially from the shaft to form a support mechanism for spool 47 that contains a supply of wire wound thereon. The extreme left end of the spindle is threaded to receive a washer 49 and nut 51 (after spool 47 has been inserted onto the spindle). Nut 51 clamps spool 47 against disk 43 so that the spool rotates with shaft 41 for winding the wire onto the spool or unwinding the wire off of the spool, depending on the direction of shaft rotation.

Figure 3:
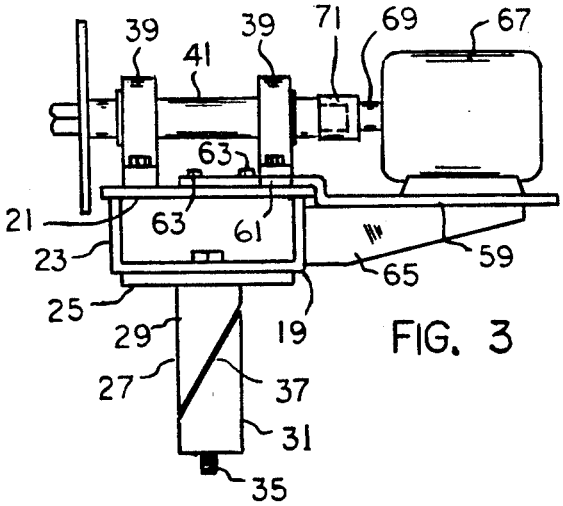
FIG. 3 is a fragmentary elevational view of the FIG. 1 device, showing an electric motor as an alternate power source for the winding operation.

Shaft 41 can be rotated manually or by means of an electric motor. FIG. 1 shows the manual mode of operation. FIG. 3 shows the motorized operational mode. As seen in FIG. 1, the shaft-rotating means comprises a hand crank 53 having a non-circular socket 55 fitted onto the square end 57 of shaft 41. The hand crank can be disengaged from the shaft when it is desired to switch to the motorized operational mode.

FIG. 3 shows a shelf structure 59 having a mounting bracket 61 extending along the upper surface of platform 19; bolts 63 are threaded into threaded openings in plate 21 to rigidly (but detachably) affix the shelf structure to the platform so that the upper surface of the shelf is approximately in the same plane as the upper surface of the platform. Mounting bracket 61 has central edge areas thereof cut away to clear the rightmost bearing 39. The shelf structure can include a depending vertical plate 65 whose left edge is engageable against a side surface of platform 19 for the purpose of reinforcing the shelf structure 59 against the weight of electric motor 67. The motor is suitably bolted to the shelf structure.

Output shaft 69 of the motor carries a socket structure 71 that fits onto the square end of shaft 41, whereby the motor is operatively connected to the shaft for powering the shaft during the wire-winding operation.

During the process of winding the wire onto spool 47, or unwinding the wire from the spool, the truck is driven slowly along the wire path. During the wire-winding operation a person sitting in the cargo box can control the operation, e.g. by turning crank 53 or energizing/deenergizing motor 67. The wire-unwind operation is accomplished merely by driving the truck slowly in the desired direction; truck motion causes the wire to be drawn off the spool.

Figure 2:
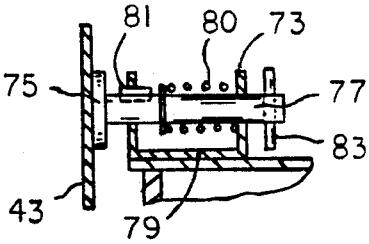
FIG. 2 is a fragmentary sectional view taken through a friction drag means used in the FIG. 1 device.

In order to minimize any tendency for uncontrolled spinning of the spool during the wire-unwind operation, a friction drag means 73 is operatively engaged against radial disk 53. As shown in FIG. 2, the friction drag means comprises a friction pad 75 carried on a spring-biased plunger 77. The plunger is slidably mounted in a bracket 79 suitably affixed to platform 19. A coil spring 80 exerts a leftward bias on plunger 77 whereby pad 75 is frictionally engaged against the side face of disk 43, for thereby controlling the rotational velocity of spool 47.

During the wire-winding operation it is not desired to impose a frictional drag on the spool (or disk 43). Therefore, a latch means is provided to hold friction pad 75 in a retracted position spaced rightwardly out of contact with disk 43. A key 81 is carried on plunger 77 for slidable movement through a slot in the wall of bracket 79. Handle 83 on the plunger can be pulled to draw key 81 out of the slot; by then turning the handle the key will be reoriented so that its left edge abuts the bracket wall, to thus retain the plunger 77-pad 75 assembly in a retracted position.

The illustrated apparatus was specifically designed for laying (or winding) electric fence wire. However, it is believed that the apparatus could be used for other winding applications, such as the laying of barbed wire.

What is claimed is:

1. In a pickup truck that includes a cargo box having a side wall, and a stake pocket in said side wall: the improvement comprising a platform extending directly above the cargo box side wall and overlying the stake pocket; a post structure extending downwardly from said platform for disposition within the stake pocket; two spaced bearings mounted on said platform, said bearings being aligned on a horizontal axis extending crosswise of the cargo box side wall; a horizontal rotary shaft extending through said aligned bearings so that one end of the shaft is located within the truck cargo box and the other end of the shaft is located outboard from the cargo box beyond said bearings; means attached to said other end of the shaft for removably supporting a spool of wire outboard from the cargo box side wall; and means attached to said one end of the shaft for rotating the shaft, whereby wire can be wound on or off of the spool depending on the direction of shaft rotation; said post structure comprising an upper post section, a lower post section, and a threaded tie rod extending downwardly from the platform through the post sections; said post sections having mating cam surfaces acutely angled to the tie rod axis, whereby manual rotation of the tie rod causes the post sections to shift laterally into gripment with the stake pocket side surfaces.

* * * * *